US005376311A

United States Patent [19]

DeGuzman

[11] Patent Number: 5,376,311

[45] Date of Patent: Dec. 27, 1994

[54] APPARATUS FOR MIXING GAS AND LIQUID

[76] Inventor: Vel DeGuzman, 5110 Faucett Rd., Pine Bluff, Ark. 71603

[21] Appl. No.: 200,074

[22] Filed: Dec. 6, 1993

[51] Int. Cl.[5] ..... B01F 3/04

[52] U.S. Cl. ..... 261/77; 261/122.1

[58] Field of Search ..... 261/77, 122.1

[56] References Cited

U.S. PATENT DOCUMENTS

| | | | |
|---|---|---|---|
| 1,512,591 | 10/1924 | Friedrichs | 261/77 |
| 1,987,655 | 1/1935 | Zellhoefer | 261/122.1 |
| 2,294,973 | 9/1942 | Ford | 261/122.1 |
| 2,430,749 | 11/1947 | Van Denburg | 261/122.1 |
| 2,637,541 | 5/1953 | Rubin | 261/122 |
| 2,744,065 | 5/1956 | Lacey | 261/77 |
| 2,986,382 | 5/1961 | Langdon | 261/124 |
| 3,165,562 | 1/1965 | Young et al. | 261/122.1 |
| 3,424,443 | 1/1964 | Thayer | 261/163 |
| 3,608,834 | 9/1971 | MacLaren | 239/571 |
| 3,969,446 | 7/1976 | Franklin, Jr. | 261/77 |
| 3,989,477 | 11/1976 | Wilson et al. | 261/122.1 |
| 4,333,829 | 6/1982 | Walther | 261/122.1 |
| 4,557,879 | 12/1985 | Weber | 261/122 |
| 4,563,277 | 1/1986 | Tharp | 210/220 |
| 4,629,591 | 12/1986 | Forsyth | 261/122 |
| 4,680,119 | 7/1987 | Franklin, Jr. | 210/512 |

*Primary Examiner*—Tim Miles

[57] ABSTRACT

An apparatus for mixing gas and liquid comprising a generally rectangular concrete base, a vertically extending cylindrical housing mounted on said concrete base and having a hollow interior, an open end portion and a bottom portion embedded on said concrete base, said bottom portion being provided with horizontal reinforcing bars passing through the walls of said cylindrical housing to anchor said housing with said concrete base, said cylindrical housing being provided with a plurality of apertures disposed at the lower section thereof proximate said concrete base. Gas diffuser means concentrically held inside cylindrical housing, said gas diffuser means being defined by an elongated porous tubular member provided with a cap fitted at the top end portion thereof and an elbow fitting detachably secured at the bottom end portion thereof. Inlet means consisting of a main pipe having opposite first and second ends, said first end being fitted on said elbow fitting and said second end being connected to a main air supply and holder means snugly fitted and screwably secured inside said cylindrical housing, said holder means being adapted to hold said porous tubular member in a vertical position as gas from the main supply is distributed therein.

5 Claims, 2 Drawing Sheets

APPARATUS FOR MIXING GAS AND LIQUID

FIELD AND BACKGROUND OF THE INVENTION

The field of this invention generally relates to the mixing of gases with liquids. More specifically, it relates to the aeration of liquids by passage of gas (usually oxygen from the atmosphere) through a porous diffuser element producing microsized bubbles which are dispersed within the liquid. The fine bubble diffuser transfers the gas into the liquid with relatively high efficiency due to increased interface areas of gas and liquid.

DESCRIPTION OF THE PRIOR ART

Aeration of liquids is commonly performed, for example, to accelarate bacteriological decomposition of liquid waste, to prevent algae formation on the surfaces of stagnant pools or ponds, and so forth. The term "aeration" as employed herein is to be understood as denoting the introduction of any type of gas in any type of liquid.

The simplest method of aeration comprises introducing a gas into a liquid through holes in an appropriate supply line. Some of this gas is absorbed as the gas bubbles rise through the liquid. Unabsorbed gas escapes from the surface of the liquid, and may or may not be captured for circulation repeatedly.

In spite of its simplicity, this method is very inefficient. The gas bubbles, even if small, when introduced into the liquid, tend to aggregate into large bubbles or slugs of gas as they rise. The gas slugs have comparatively small surface-area-to-volume ratios, thus relatively little gas-to-liquid contact. This results in relatively low rates of gas absorption by the liquid at the liquid-gas interfaces. If the openings in the gas outlet are made very small to introduce small gas bubbles, gas transfers to the liquid are highly increased. In addition, the transit time of the gas through the liquid may be quite short if the liquid container, for example, a pond or holding tank, is shallow. This short gas-to-liquid contact time further results in inefficient rate of gas absorption by the liquid. Furthermore, turbulence is created for disrupting the liquid-gas interfaces, disruption and renewal of the interfaces being essential for high rates of gas absorption or mass transfer.

Some slight improvement in absorption efficiency is obtained by the use of nozzles at the gas injection openings which introduce the gas into the liquid in a swirling manner so as to create some degree of turbulence. This tends to delay somewhat the formation of large gas slugs and to disperse the gas bubbles through a large volume of liquid. However, high absorption efficiencies are still not obtained.

More commonly used processes employ the pneumatic (or air) lift pump principle. When a gas is bubbled up through an elongated tube which is vertically submerged in a liquid, the buoyancy force of the rising gas bubbles causes an upward lifting or flow of the liquid through the tube. This upward flow causes a circulation within the entire body of liquid, with the liquid continually being drawn into the bottom of the tube and being discharged from the top thereof. Turbulence in the liquid above the top of the tube (which is normally submerged well below the surface of the liquid) tends to improve the absorption rate of the gas by breaking up, to some extent, large gas slugs and by disrupting and renewing the liquid-gas interfaces. The liquid circulation and turbulence caused by such pneumatic lifts may also be used to prevent formation of ice on the surface of the liquid, or so reduce the magnitude of surface waves, for example in a harbor area. The absorption efficiency obtained is still much less than desired, however, because large gas slugs tend to form and remain unbroken, and because the gas-liquid contact time is not appreciably increased. Therefore a considerable amount of gas must be pumped through such pneumatic lift tubes in order that a small amount may be absorbed by the liquid. Because of the inefficiency in the absorption process, much of the energy used to pump the gas is wasted.

Helical tube dividers such as fins or "fingers" installed in some pneumatic lift tubes increase the gas-liquid contact time by providing increased path links for the gas bubbles to travel as they spiral up through the tubes. In addition, the gas and liquid exit from the tops of the tubes with a rotational motion, thereby somewhat increasing the turbulence thereabove. However, large slugs of gas still tend to form within the tubes, with still relatively poor absorption efficiency. Some helical tube dividers are provided with holes interconnecting the adjacent chambers to help prevent formation of large gas slugs. The gas absorption efficiency is still much less than desired. Gas which is not absorbed in the bubble transit through the liquid is either lost or must be repumped through the liquid. This requires additional gas pumping capacity and horsepower.

Because of inefficiencies of present pneumatic lift tube aerators, it has been necessary to pump relatively large amounts of gas through the liquid—only a relatively small portion actually being absorbed by the liquid—and to employ a relatively large number of pneumatic lift tubes, particularly when the liquid is contained in shallow tanks or ponds and short tubes must be used. Thus, there has been considerable wastage of gas pumping power with resulting high costs involved in such complex aerator systems.

Some aerators include a motor-driven, horizontally rotating submerged turbine. The non-enclosed turbine is generally positioned above a source of gas bubble and is used to break up and disperse the released gas bubbles and to create turbulence in the liquid. Other aerators usually rely upon the air above the surface of the liquid, some of which become entrapped in the churning liquid, for aeration. However, motor-driven aeration systems are expensive to produce, to operate as well as to maintain. A source of power for the motor must also be available.

More recently, an aerator having an increased efficiency for dispersing the gas in the liquid comprises an elongated tube having openings at both ends and having mounted therein one or more turbines which are free to rotate about the longitudinal axis thereof. The tube is vertically submerged in a liquid such as a lake or pond of water. Air is supplied to the lower end of the tube. Gas bubbles rising through the tube cause an upward flow of liquid therethrough. The turbines are rotated solely by this upward flow of gas and liquid. This rotation of the turbine causes the gas bubbles to be broken up into a vast number of much smaller gas bubbles which are dispersed throughout the liquid so that optimum gas absorption may occur. When more than one turbine is used, the turbines are so constructed that adjacent turbines rotate either at different speeds or in counter-direction to thus optimize the breaking up of the gas bubbles. Although this device provides improved aeration efficiency, it suffers from the disadvantage that, when pumping liquid waste which contains such materials as hair, the hair becomes entangled in the turbine blades, thus reducing the efficiency of the aerator.

Thus, the present invention provides an apparatus for mixing gases with liquids which may contain solid matter, e.g. hair, which will plug or foul aeration devices known in the prior art.

SUMMARY OF THE INVENTION

The present invention according to its preferred embodiment tends to overcome the disadvantages of the aerator disclosed in the prior art by providing an apparatus for mixing gasses and liquids and at the same time pumping the resulting mixture comprising a generally rectangular concrete base, a vertically extending cylindrical housing mounted on said concrete base and having a hollow interior, an open top end portion and a bottom portion embedded on said concrete base, said bottom portion being provided with horizontal reinforcing bars passing through the walls of said cylindrical housing to anchor said housing with said concrete base, said cylindrical housing being provided with a plurality of apertures disposed at the lower section thereof proximate said concrete base, gas diffuer means concentrically held inside said cylindrical housing, said gas diffuser means being defined by an elongated porous tubular member provided with a cap fitted at the top end portion thereof and an elbow fitting detachably secured at the bottom end portion thereof, inlet means consisting of a main pipe having opposite first and second ends, said first end being fitted on said elbow fitting and said second end being connected to a main air supply and holder means snugly fitted and screwably secured inside said cylindrical housing, said holder means being adapted to hold said porous tubular member in a vertical position as gas from the main supply is distributed therein.

The holder means is disposed preferably at the upper and lower sections of said cylindrical housing. Said holder means is further defined by a pair of first rings provided with a plurality of radial arms and forming therefrom a second ring concentrically disposed on said first ring. The rings are made of ABS mold-injected plastic including the radial arms. The porous tubular member is snugly fitted in upright or vertical position into the second rings. While the first rings are screwably secured on the cylindrical housing by providing threads on the axis of the raidal arms and corresponding holes on the cylindrical housing.

With the provisions of the above mentioned apparatus, it is the main object of this invention to provide an aerator/apparatus for mixing gas and liquid having a very efficient gas transfer capability and a high performance capability of mixing basin or lagoon contents by airlift pumping action.

Another object of this invention is to provide an aerator/apparatus for mixing gas and liquid capable of producing much finer microsized bubbles.

Another object of this invention is to provide an aerator/apparatus for mixing gas and liquid which is economical in terms of maintenance requirements since the present invention is simple in construction and has no moving parts.

The present invention can be used for various purposes whenever liquids are to be permeated with gas (usually oxygen from the atmosphere) this includes, among others, the aeration or gas mass transfer in waste water treatment lagoon, for fishponds or tank, aeration of lakes for algae control, for reduction of biological oxygen demand (or BOD) and chemical oxygen demand (or COD) in impounded liquids, for aeration of domestic water supply reservoirs, for removal of undesirable residual gases and minerals such as chlorine, hydrogen sulfide and iron, for hydrotherapeutic or medical baths requiring gas bubbles and for putting dissolved oxygen levels in any body of water to sustain marine animal life.

Further scope of the applicability of the present invention, advantages and objects thereof, will become apparent from the different description of the drawings and detailed description given hereinafter.

Brief description of the several views of the drawings:

Referring now to the different views of the drawings, there is shown in FIG. 1 an apparatus for mixing gas and liquid in the preferred embodiment of the present invention denoted by reference numeral 1. Said apparatus (aerator) comprising a cylindrical housing 2 mounted on a concrete rectangular base 3. As shown in FIGS. 1 and particularly FIG. 2, said cylindrical housing is fixedly mounted in an upright or vertically extended position on said concrete base.

The cylindrical housing 2 preferably made from plastic material has a hollow interior, an open top end portion and a bottom end portion embedded at a depth "d" on the concrete base. A plurality of horizontal reinforcing bars 4 are then passed through the walls of said cylindrical housing at points "A" to anchor said cylindrical housing with said concrete base. In a preferred embodiment of the invention the reinforcing bars 4 are placed at right angles with each other.

Further provided on said cylindrical housing is a plurality of apertures 5 disposed at lower section thereof proximate the upper most portion of the concrete base. Also, in a preferred embodiment of the present invention they are made with 2 inch diameters and arranged in two rows equally spaced and staggered around the circumference or surface of the cylindrical housing.

Figure 1:
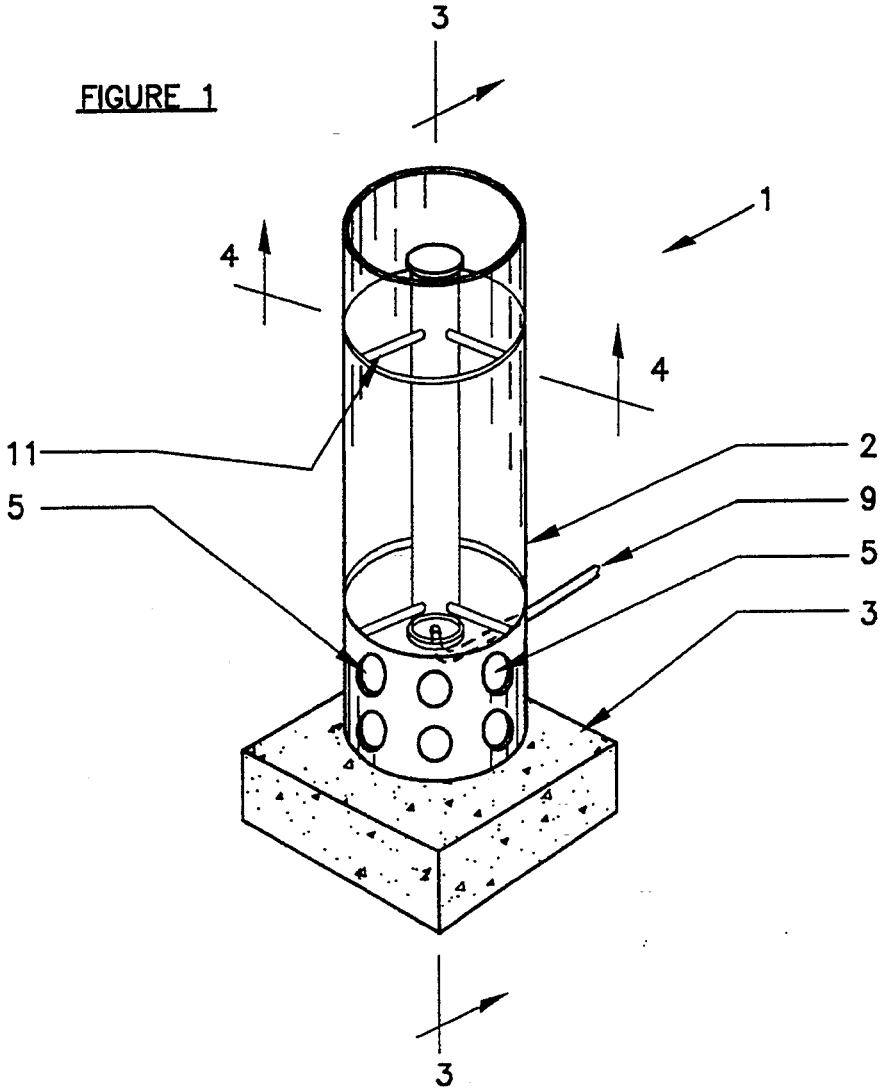
FIG. 1 is a perspective view of the apparatus for mixing gas and liquid of the present invention.
Figure 2:
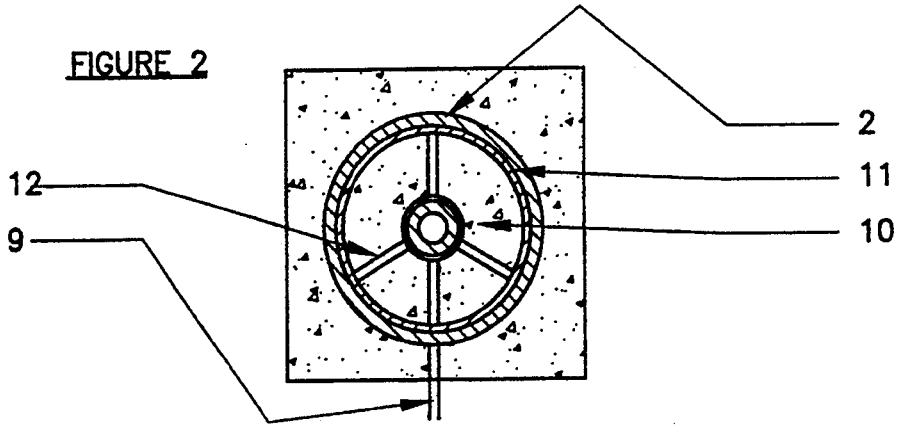
FIG. 2 is a top view thereof.
Figure 3:
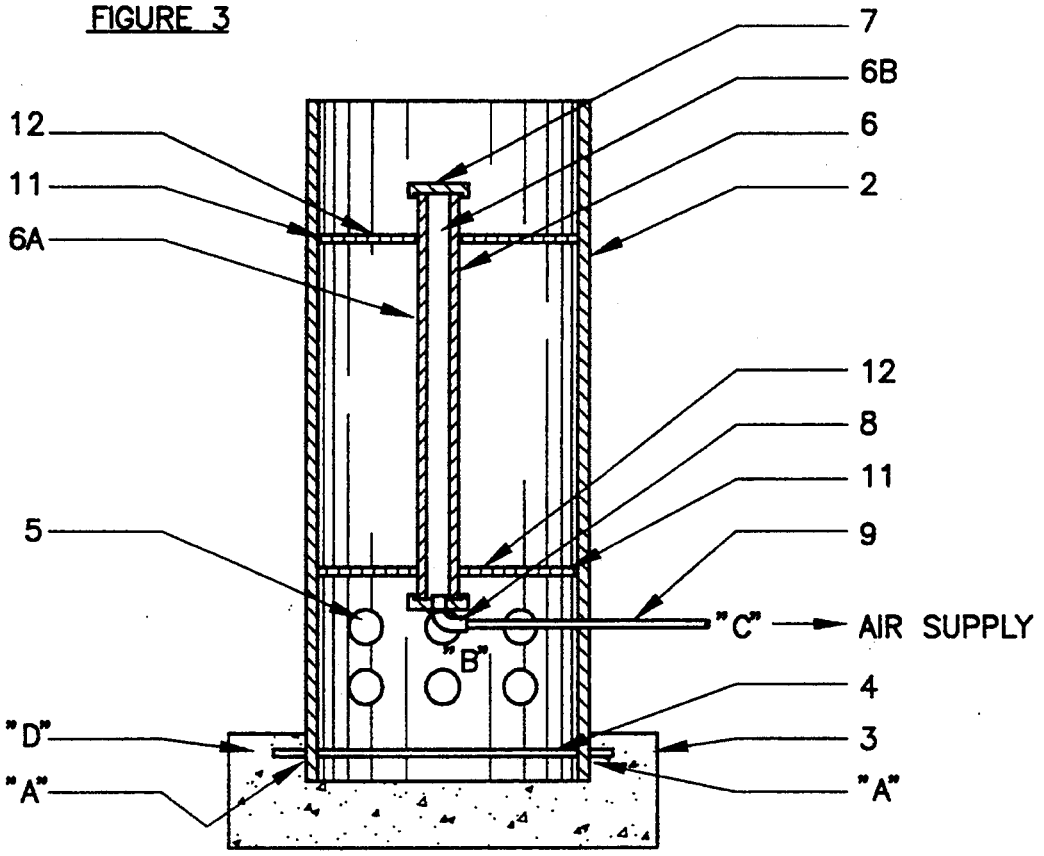
FIG. 3 is a sectional view taken along line 3-3.
Figure 4:
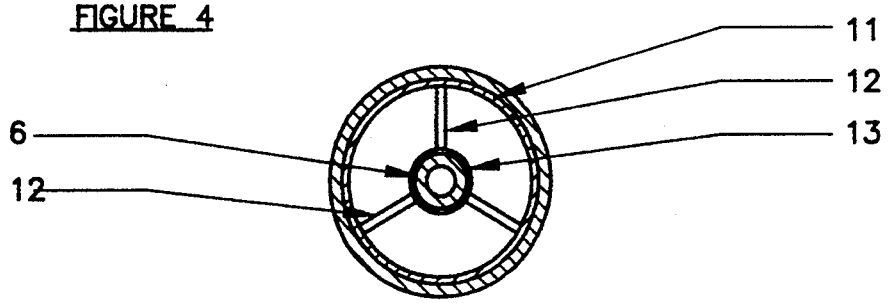
FIG. 4 is a sectional view taken along line 4-4.

Referring now to FIG. 3, the aerator of the present invention is further provided with a gas diffuser means defined by a porous tubular member 6. Said tubular member is made of porous high density carbon, porous fused silica or porous ceramic with porosity index of no less than 0.50. It is preferred that the dimensions of the internal diffuser element or tubular member be 1½ inches in diameter and 18 inches in length. Said tubular member is provided with a cap 7 fitted at the top end portion thereof and an elbow fitting 8 detachably secured at the bottom end portion of said tube. The elbow fitting is screwably fitted on said bottom end portion. The tubular member has porous sides **6*a* and a central opening 6*b* to receive air from the inlet means. Said inlet means consists of a main pipe 9 having opposite first and second ends (points B and C, respectively), said first end being fitted on one end of said elbow fitting 8**, preferably by means of a slip-on bushing, and said second end being connected to a main air supply (not shown).

The porous tubular member 6 is held in an upright position and is cocentrically disposed inside said cylindrical housing 2. Said tubular member is held in a snugly fitted manner by a pair of holders 10 defined by a first ring 11 having a plurality of radial arms 12 and forming therefrom a second ring 13. Said second ring 13 is concentrically disposed with respect to said first ring. The tubular member 6 is designed with a diameter less than that of the second ring. Provisions are made on both elements to effect a snugly-fit relationship and prevent the tubular tube from falling. The holder means defined by holders 10 are screwably secured at the upper and lower section of the cylindrical body by providing threads on the first ring along the axis of the radial arms and corresponding threads on the walls of the cylindrical housing. Furthermore, said first ring is snugly fitted into said cylindrical housing.

In the preferred embodiment of the invention, the holders are injection molded and provided with three (3) radial arms. Also, the cylindrical housing is constructed using high impact corrosion resistant ABS pipe.

Pump action is achieved by the present apparatus firstly by means of apertures 5 which provides for the vertical uplift flow of water and secondly, by means of the microsize bubbles produced from the tubular member which rise and provide internal turbulence for mass oxygen transfer and with the housing acting as the enclosed cylinder, airlift pump action for vertical mass mixing of the liquid is achieved.

Operation of the present invention is simple. By supplying gas through the main pipe 9, bubbles are produced as gas escapes from the porous sides *6a* of the tubular member.

While the preferred embodiment of this invention has been described above in detail, it is to be understood that variations and modifications can be therein without departing from the spirit and scope of the present invention.

I claim:

1. An apparatus for mixing gas and liquid comprising:

generally rectangular concrete base;

a vertically extending cylindrical housing mounted on said concrete base and having a hollow interior, and open top end portion and a bottom portion embedded on said concrete base, said bottom portion being provided with horizontal reinforcing bars passing through the walls of said cylindrical housing to anchor said housing with said concrete base, said cylindrical housing being provided with a plurality of apertures disposed at the lower section thereof proximate said concrete base;

gas diffuser means concentrically held inside said cylindrical housing; said gas diffuser means being defined by an elongated porous tubular member provided with a cap fitted at the top end portion thereof and an elbow fitting detachably secured at the bottom end portion thereof;

inlet means consisting of a main pipe having opposite first and second ends, said first end being fitted on said elbow fitting and said second end being connected to a main air supply; and holder means snugly fitted and screwably secured inside said cylindrical housing, said holder means being adapted to hold said porous tubular member in a vertical position as gas from the main supply is distributed therein.

2. An apparatus for mixing gas and liquid in accordance with claim 1, wherein said holder means being disposed at the upper and lower sections of said cylindrical housing consists of a pair of first rings, each of said first rings having a plurality of radial arms and forming therefrom a second ring concentrically disposed on said first ring, said second ring being adapted to receive said porous tubular member, and said porous tubular member being adapted to snugly fit with said second ring.

3. An apparatus for mixing gas and liquid in accordance with claim 1, wherein said porous tubular member is made from porous high density carbon material.

4. An apparatus for mixing gas and liquid in accordance with claim 1, wherein said porous tubular member is made from porous fused silica material.

5. An apparatus for mixing gas and liquid in accordance with claim 1, wherein said porous tubular member is made from porous ceramic material.

* * * * *